US006378566B1

(12) United States Patent
Kornett

(10) Patent No.: US 6,378,566 B1
(45) Date of Patent: Apr. 30, 2002

(54) ENHANCEMENTS FOR SEAMS IN ON-MACHINE-SEAMABLE PAPERMAKER'S FABRICS

(75) Inventor: Glenn J. Kornett, Bonneau Beach, SC (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/788,196

(22) Filed: Feb. 16, 2001

(51) Int. Cl.[7] ..... D03D 23/00; D03D 25/00
(52) U.S. Cl. ..... 139/383 AA
(58) Field of Search ..... 139/383 AA

(56) References Cited

U.S. PATENT DOCUMENTS 3,664,907 A * 5/1972 Price ..... 161/89
3,815,645 A 6/1974 Codorniu
5,476,123 A 12/1995 Rydin
5,531,251 A 7/1996 Rydin
5,904,187 A 5/1999 Davenport
6,174,825 B1 * 1/2001 Dutt ..... 442/43

* cited by examiner

*Primary Examiner*—Andy Falik
(74) *Attorney, Agent, or Firm*—Pitney, Hardin, Kipp & Szuch LLP

(57) ABSTRACT

An on-machine-seamable papermaker's fabric, which may be produced by modified endless weaving, includes machine-direction (MD) and cross-machine-direction (CD) yarns. When so produced, the MD yarns weave continuously back and forth between the two widthwise edges of the fabric, each time forming a seaming loop at one of the two widthwise edges. Interwoven with at least one of the two sides, top and bottom, of the seaming loops at one or both widthwise edges are at least two additional CD yarns. The additional CD yarns interweave with the top and/or bottom of the seaming loops in a leno weave, which keeps the seaming loops in a common position vertically relative to the plane of the papermakers fabric, locks the seaming loops into a desired position and orientation with their planes perpendicular to that of the papermaker's fabric.

54 Claims, 10 Drawing Sheets

ENHANCEMENTS FOR SEAMS IN ON-MACHINE-SEAMABLE PAPERMAKER'S FABRICS

BACKGROUND OF THE INVENTION

1. Field of the Invention

The present invention relates to the papermaking arts. More specifically, the present invention is a papermaker's fabric of the on-machine-seamable variety, such as an on-machine-seamable press fabric for the press section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water drains from the slurry through the forming fabric during this process, leaving the cellulosic fibrous web on the surface of the forming fabric.

The newly formed web proceeds from the forming section to a press section, which includes a series of press nips. There, the web passes through the press nips supported by a press fabric, or, as is often the case, between two press fabrics. In the press nips, the web is subjected to compressive forces which squeeze water therefrom, and which adhere the cellulose fibers in the web to one another to turn it into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

Referring, for the moment, specifically to press fabrics, it should be recalled that, at one time, press fabrics were supplied only in endless form. This is because a newly formed paper sheet is extremely susceptible to marking in the press nip by any nonuniformity in the press fabric or fabrics. An endless, seamless fabric, such as one produced by the process known as endless weaving, has a uniform structure in both its longitudinal (machine) and transverse (cross-machine) directions. A seam, such as a seam which may be used to close the press fabric into endless form during installation on a paper machine, represents a discontinuity in the uniform structure of the press fabric. The use of a seam, then, greatly increases the likelihood that the paper sheet will be marked in the press nip.

It follows, then, that the seam region of any workable on-machine-seamable, or OMS®, press fabric must behave under load, that is, under compression in a press nip, like the rest of the press fabric, and must have the same permeability to water and to air as the rest of the press fabric, in order to prevent the paper product being manufactured from being marked by the seam region. OMS® is a registered trademark of Albany International Corp.

Despite the considerable technical obstacles presented by these requirements, it remained highly desirable to develop an on-machine-seamable press fabric because of the comparative ease and safety with which it could be installed on a press section. Ultimately, these obstacles were overcome with the development of press fabrics having seams formed by providing seaming loops on the crosswise edges of the two ends of the fabric. The seaming loops themselves are formed by the machine-direction (MD) yarns of the fabric. A seam is formed by bringing the two ends of the press fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an on-machine-seamable press fabric, than it is to install an endless press fabric, on a paper machine.

There are several methods for producing a press fabric that can be joined on the paper machine with such a seam. One method is to flat-weave the fabric, in which case the warp yarns are the machine-direction (MD) yarns of the press fabric. To form the seaming loops, the warp ends are woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the press fabric, is continuous, the seaming loops obtained in this manner are stronger than any that can be produced by weaving the warp ends back into the ends of a flat-woven fabric. In still another method, a fabric is woven endless, and the endless loop of fabric of fabric thereby obtained is flattened and given the form of two fabric layers joined to one another at two widthwise ends of the flattened loop. One or more widthwise yarns are then removed from each of the two widthwise ends to produce a short gap defined by the freed, that is, the newly unwoven portions of, lengthwise yarns at each end. These unwoven portions of the lengthwise yarns are then used as seaming loops when the two widthwise ends are brought together as described above.

Generally, the manufacture of an on-machine-seamable press fabric includes the attachment of a staple fiber batt to one or both of its two sides. The attachment may be effected by a process called needling (fiber locking) or by hydroentangling, while the on-machine-seamable fabric is in endless form. Once the desired amount of staple fiber batt has been attached, the loop-forming pin or pintle is removed to place the press fabric into flat, or open, form for shipment and eventual installation on a paper machine. At that time, the staple fiber batt must be cut in the vicinity of the seam to completely separate the two ends of the press fabric from one another. Often, the staple fiber batt is cut in a manner that enables it to form a flap over the seaming loops when the press fabric is rejoined into endless form. For this reason, the two ends of the press fabric are often referred to as the "flap" end, which has the flap of staple fiber material extending over and beyond the seaming loops, and the "no-flap" end, which has a space, adjacent to its seaming loops, into which the flap on the other end fits when the fabric is joined into endless form. It should be noted that, when the fabric is installed on a paper machine, the orientation of the fabric is such that the "flap" end will lead the "no-flap" end through the press nip or nips to prevent the flap from wearing away too quickly.

On the other side, the so-called "roll" side, of the press fabric, however, some staple fiber batt may be removed from the seaming loops to facilitate the subsequent passage of a pintle therethrough. The removal of this generally small amount of staple fiber batt, nevertheless, makes the seam region slightly more permeable to air and water than the rest of the press fabric. This difference in permeability, or flow resistance, perhaps ever so slight, is enough to cause sheet marking in some situations.

Several approaches have been taken toward solving this problem. One approach involves the use of stuffer yarns with the pintle when the press fabric is being joined into endless form on the paper machine. In another approach, a press fabric comprises two on-machine-seamable base fabrics, one fitting inside the endless loop formed by the other, the two base fabrics being laminated to one another during the needling process. The seam regions of the inner and outer base fabrics are offset slightly with respect to one another, so that the seam region of each will coincide with a non-seam region of the other. Once the desired amount of staple fiber batt has been attached to the inner and/or outer surfaces of the laminated base fabrics, the loop-forming pin or pintle of each on-machine-seamable base fabric is removed to place the press fabric into flat form for shipment and eventual installation on a paper machine. At that time, the staple fiber batt must be cut in the vicinity of the seam in the outer of the two on-machine-seamable base fabrics to completely separate the two ends of the press fabric from one another. As above, the staple fiber batt may be cut in a manner that enables it to form a flap over the seaming loops when the press fabric is rejoined into endless form. Some of the staple fiber batt may also be removed from the seaming loops of both the inner and outer on-machine-seamable base fabrics to facilitate the subsequent passage of pintles therethrough.

In yet another approach, disclosed in U.S. Pat. Nos. 5,476,123 and 5,531,251 to Rydin, one or more extra CD yarns are woven with the seaming loops of at least one end of a base fabric of an on-machine-seamable press fabric. The extra yarn or yarns are woven only with those portions of the seaming loops that are on one side of the fabric, that side preferably being the paper-supporting side. The extra CD yarn or yarns form an extension of the CD yarn system of the base fabric at the seaming loop or loops, conforming the seam region more closely to the rest of the base fabric, so that staple fiber batt will be better anchored to the seam region and so that the possibility of sheet marking by the seam region will be reduced.

Typically, one extra CD yarn is woven with those portions of the seaming loops on the paper-supporting side of the fabric in a plain weave. While this has been found to reduce the marking of the paper sheet being manufactured by the seam region, this benefit has been accompanied by the drawback that the extra CD yarn woven in a plain weave tends to raise those seaming loops where it weaves under the portions thereof on the paper-supporting side of the fabric, and to lower those seaming loops where it weaves over the portions thereof on the paper-supporting side of the fabric. In other words, the vertical positions of alternate seaming loops lie in one plane, while those in between lie in another plane displaced slightly in a direction perpendicular to the plane of the fabric. As a consequence, when the fabric is to be joined into endless form, the interdigitated seaming loops will never line up perfectly, making the task of threading a pintle through the passage formed by the interdigitated seaming loops more difficult. The smaller the diameter of the seaming loops, the more serious will be the difficulty of closing the fabric into endless form, as the diameter of the extra CD yarn will represent a larger percentage of the diameter of the seaming loops as a whole, leaving proportionally less area available for the pintle. The use of an extra CD yarn of lighter weight, woven at lower tension on the loom, reduces the plane difference somewhat, but once the extra CD yarn is too light, it cannot fill its intended function.

The present invention provides a solution to the foregoing problem.

SUMMARY OF THE INVENTION

Accordingly, the present invention is an on-machine-seamable papermaker's fabric which comprises a system of machine-direction (MD) yarns and a system of cross-machine-direction (CD) yarns. The MD yarns are interwoven with the CD yarns in a preselected weave pattern to form the papermaker's fabric in a rectangular shape with a length, a width, two lengthwise edges, two widthwise edges, a first side and a second side. The MD yarns form seaming loops along each of said two widthwise edges. The seaming loops also have a first side and a second side coextensive with the first and second sides of the papermaker's fabric. When the papermaker's fabric is woven by a modified endless weaving technique, the MD yarns extend back and forth continuously for its length between its two widthwise edges.

At least two additional CD yarns, not part of the system of CD yarns disclosed above, are interwoven with at least one of the first and second sides of the seaming loops at one of the two widthwise edges of the papermaker's fabric in a leno weave. The leno weave reduces or eliminates any difference in the vertical position of adjacent seaming loops, locks each seaming loop in position, and maintains them in a desired orientation with their planes perpendicular to that of the fabric.

The present invention will now be described in more complete detail, with frequent reference being made to the figures identified as follows.

DETAILED DESCRIPTION OF THE PREFERRED EMBODIMENTS

Figure 1:
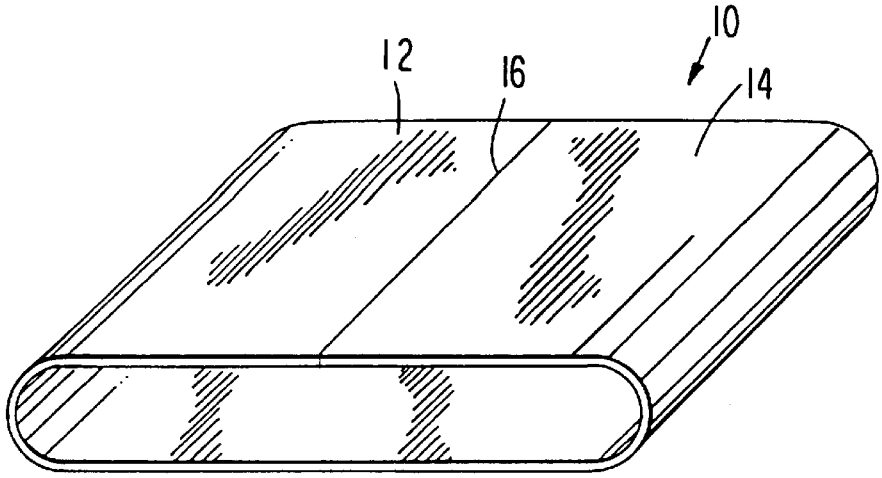
FIG. 1 is a schematic perspective view of an on-machine-seamable papermaker's fabric of the present invention.

Turning now specifically to the figures, FIG. 1 is a schematic perspective view of an on-machine-seamable papermaker's fabric 10 of the present invention. The fabric 10 takes the form of an endless loop once its two ends 12,14 have been joined to one another at seam 16.

Figure 2:
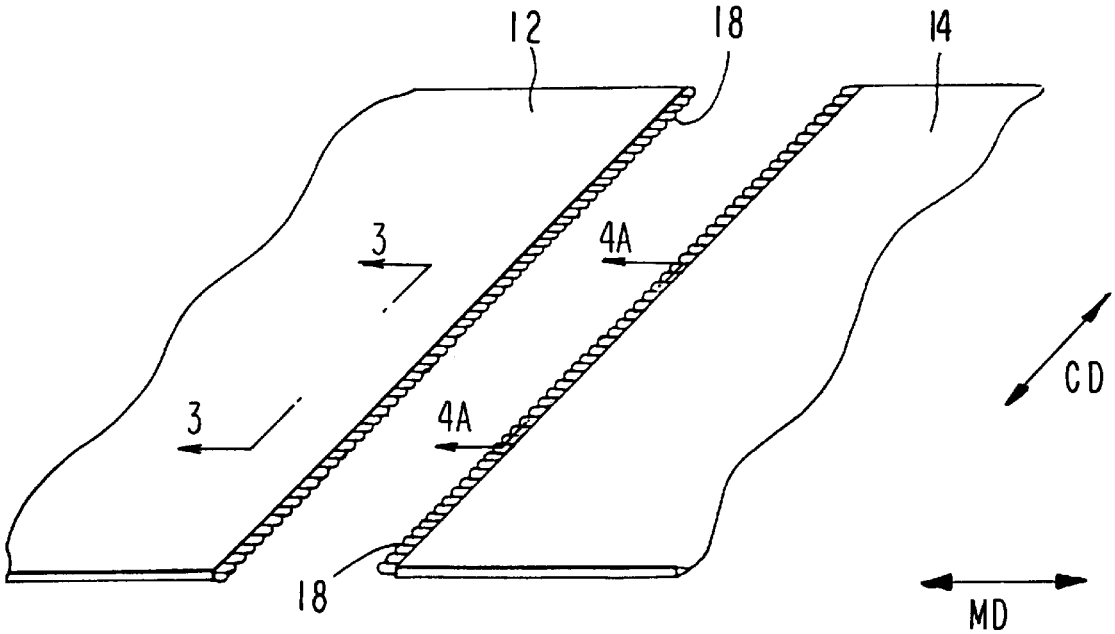
FIG. 2 is a schematic perspective view of the two ends of the on-machine-seamable papermaker's fabric prior to their attachment to one another.

FIG. 2 is a schematic perspective view of the two ends 12,14 of the on-machine-seamable fabric 10 prior to their attachment to one another. Disposed widthwise along the edges of each of the two ends 12,14 are a plurality of seaming loops 18. To attach the two ends 12,14 of the fabric 10 to one another, one brings them together, in so doing alternating and intermeshing, or interdigitating, the seaming loops 18 at one end 12 with those at the other end 14. The interdigitated seaming loops 18 define a passage through which a pin, or pintle, a yarn-like strand or member, may be directed to secure the ends 12,14 to one another.

Figure 3:
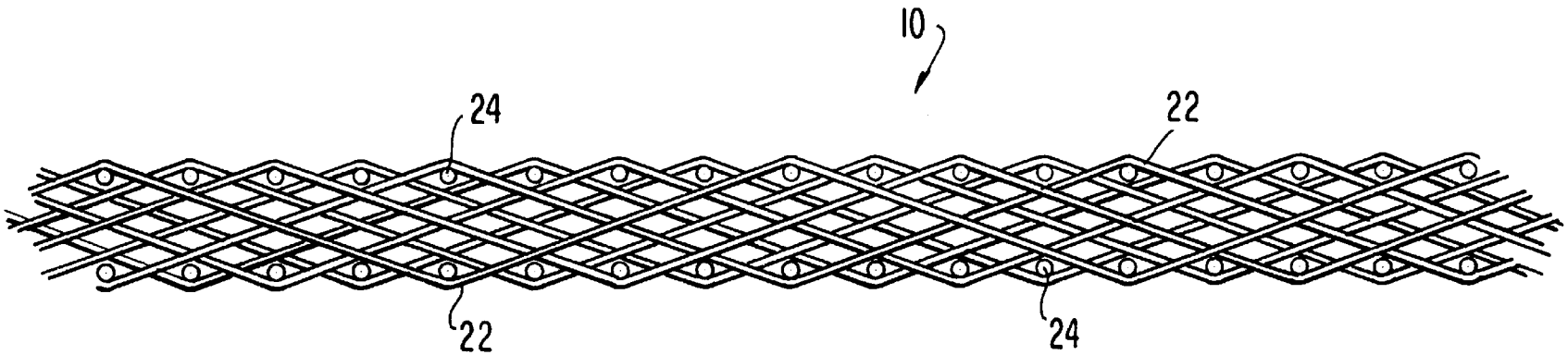
FIG. 3 is a cross-sectional view taken as indicated by line 3—3 in FIG. 2.

FIG. 3 is a cross-sectional view, taken as indicated by line 3—3 in FIG. 2, of papermaker's fabric 10. Fabric 10 is shown to be woven in an 8-shed duplex weave, although it should be understood that such a weave is shown as an example only, and that the present invention could be practiced with fabrics 10 that are woven in any other duplex weave, as well as in single-layer, triplex and multi-layer weaves, and is not limited in any way to the particular weave shown in FIG. 3. Fabric 10, which is a base fabric for a press fabric, may be needled with one or more layers of staple fiber batt material on one or both sides, or may be coated in some manner. Alternatively, fabric 10 may be used on one of the other sections of the paper machine, that is, on the forming or drying sections, or as a base for a polymeric-resin-coated, paper-industry process belt.

Fabric 10 is woven in a modified endless weaving process. In such a situation, warp yarns 22 ultimately become the cross-machine-direction (CD) yarns of the fabric 10, and the weft yarns 24 ultimately become its machine-direction (MD) yarns, when reference is made to the orientations of the yarns relative to the paper machine on which the fabric 10 is installed.

Warp yarns 22 and weft yarns 24, the CD and MD yarns of the on-machine-seamable fabric 10, respectively, may be yarns of any of the varieties used by those of ordinary skill in the art to weave paper machine clothing. That is to say, monofilament yarns, which are monofilament strands used singly, multifilament yarns, or plied/twisted yarns, in the form of plied monofilament or plied multifilament yarns, or yarns of any of the other forms used by those of ordinary skill in the art to weave paper machine clothing, may be used as warp yarns 22 and weft yarns 24.

Warp (CD) yarns 22 and weft (MD) yarns 24 comprise filaments extruded from a synthetic polymeric resin material, such as polyamide, polyester, polyetherketone, polypropylene, polyaramid, polyolefin and polyethylene terephthalate (PET) resins, and incorporated into yarns according to techniques well-known in the textile industry and particularly in the paper machine clothing industry.

In the weaving of fabric 10 by modified endless weaving, the weft yarns 24 are continuously woven back and forth across the loom, in each passage thereacross forming a loop on one of the widthwise edges of the fabric being woven by passing around a loop-forming pin. Several schemes, disclosed and claimed in U.S. Pat. No. 3,815,645 to Codorniu, the teachings of which are incorporated herein by reference, for weaving on-machine-seamable fabrics by modified endless weaving are available and may be used in the practice of the present invention. It should be understood, however, that fabric 10 need not be manufactured using a modified endless weaving technique, and that other methods, such as flat weaving, well known to those of ordinary skill in the art, could be used to do so in the alternative.

Figure 4A:
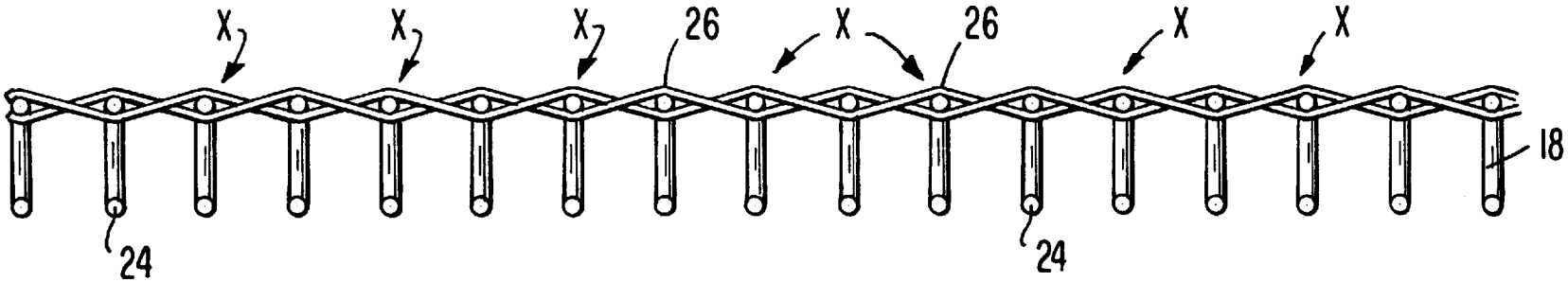
FIG. 4A is a cross-sectional view taken as indicated by line 4A—4A in FIG. 2.

FIG. 4A is a cross-sectional view taken as indicated by line 4A—4A in FIG. 2. The view depicted is taken beyond the last warp (CD) yarn 22 before the seaming loops 18 along the widthwise edge along end 14, and therefore does not show any warp (CD) yarns 22, as they are behind the viewer from the vantage point taken. Instead, FIG. 4A shows seaming loops 18, formed by weft (MD) yarns 24, from within. Interwoven with the top side of the seaming loops 18 are two extra warp (CD) yarns 26, which interweave with weft (MD) yarns 24 there in a leno weave. As such, in the particular weave shown in FIG. 4A, each extra warp (CD) yarn 26 weaves over alternate weft (MD) yarns 24 and under those in between in a plain-weave-like manner one weft (MD) yarn 24 out of step with the other, so that each weft (MD) yarn 24 has an extra warp (CD) yarn 26 above and below it. Occasionally, at points "X" in FIG. 4A, one of the extra warp (CD) yarns 26 crosses under the other to lock both in position. The combined effect of the two extra warp (CD) yarns 26, woven in this manner, is to eliminate any difference in the vertical position of alternate seaming loops 18, as the top portion of each has an extra warp (CD) yarn 26 both above and below it. That one of the two extra warp (CD) yarns 26 also crosses under the other at intervals locks each in position and keeps the planes of the seaming loops 18 in a desired orientation perpendicular to the plane of the fabric.

Figure 4B:
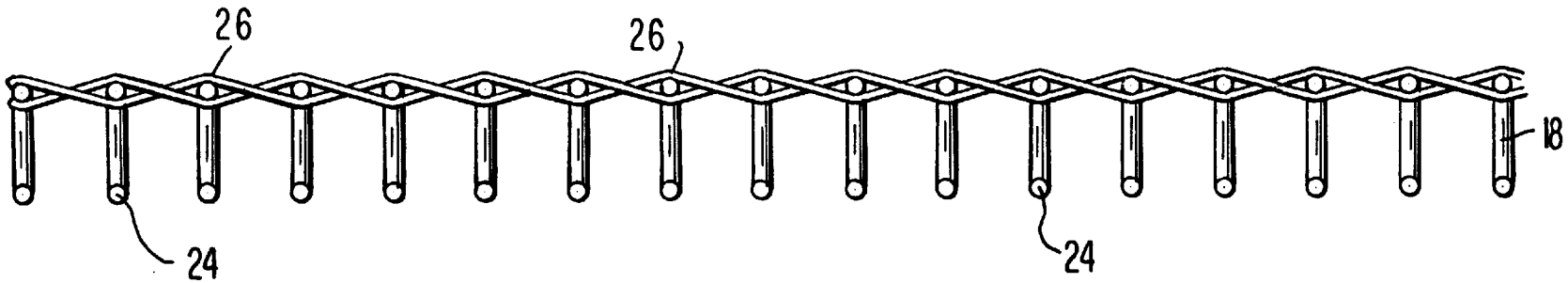
FIG. 4B is a cross-sectional view, analogous to that presented in FIG. 4A, of a variant of the embodiment shown therein.

FIG. 4B is a cross-sectional view, analogous to that presented in FIG. 4A, of a variant of the embodiment shown therein. In FIG. 4B, two extra warp (CD) yarns 26 are again interwoven with the top side of the seaming loops 18, interweaving with weft (MD) yarns 24 there in a leno weave. In the particular weave shown in FIG. 4B, each extra warp (CD) yarn 26 again weaves over alternate weft (MD) yarns 24 and under those in between in a plain-weave-like manner one weft (MD) yarn 24 out of step with the other, so that each weft (MD) yarn 24 has an extra warp (CD) yarn 26 above and below it. At every seaming loop 18, as opposed to every other seaming loop 18 as in FIG. 4A or at some other interval, one of the extra warp (CD) yarns 26 crosses under the other to lock both in position. The particular weave shown in FIG. 4B may also be used instead of that shown in FIG. 4A in the embodiments shown in FIGS. 5 and 6 and described below.

Figure 5:
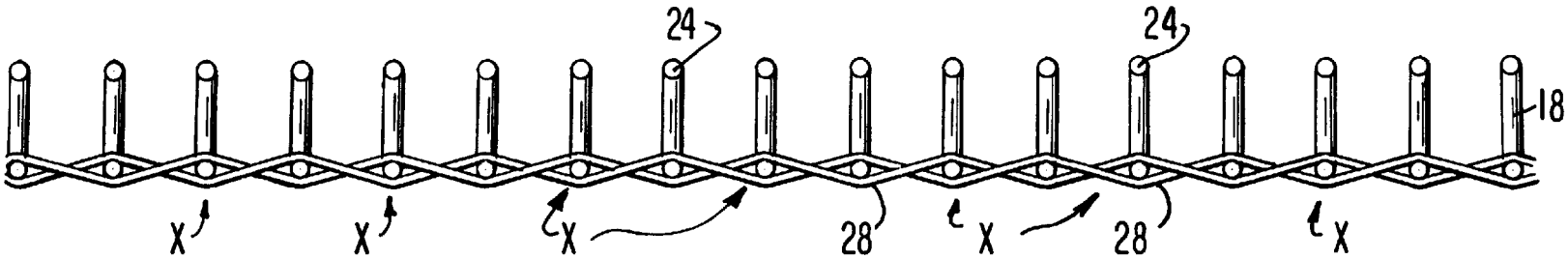
FIG. 5 is such a cross-sectional view of a second embodiment of the present invention.

FIG. 5 is a cross-sectional view, analogous to that presented in FIG. 4A, of a second embodiment of the present invention. FIG. 5 also shows seaming loops 18, formed by weft (MD) yarns 24, from within. Interwoven with the bottom side of the seaming loops 18 are two extra warp (CD) yarns 28, which interweave with weft (MD) yarns 24 there in a leno weave identical to that shown in FIG. 4A. At points "X", one of the extra warp (CD) yarns 28 crosses under the other to lock both in position. The advantages are the same as those discussed above for the embodiment shown in that figure.

Figure 6:
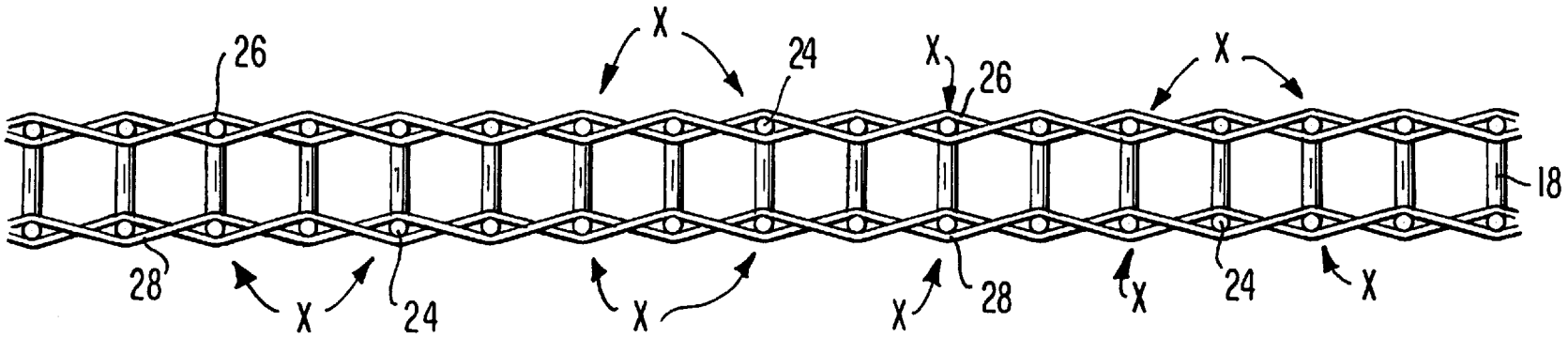
FIG. 6 is such a cross-sectional view of a third embodiment of the present invention.

FIG. 6 is a cross-sectional view, analogous to that presented in FIG. 4A, of a third embodiment of the present invention. This third embodiment may be considered to be a combination of those shown in FIGS. 4A and 5. Specifically, FIG. 6 again shows seaming loops 18, formed by weft (MD) yarns 24, from within. Interwoven with the top side of the seaming loops 18 are two extra warp (CD) yarns 26, which interweave with weft (MD) yarns 24 there in a leno weave. Interwoven with the bottom side of the seaming loops 18 are two extra warp (CD) yarns 28, which also interweave with weft (MD) yarns 24 there in a leno weave. Both leno weaves are identical to that describe above for FIG. 4A. Extra warp (CD) yarns 26 cross one another, and extra warp (CD) yarns 28 cross one another, at points "X". The advantages are the same as those discussed above for the embodiment shown in that figure.

Figure 7:
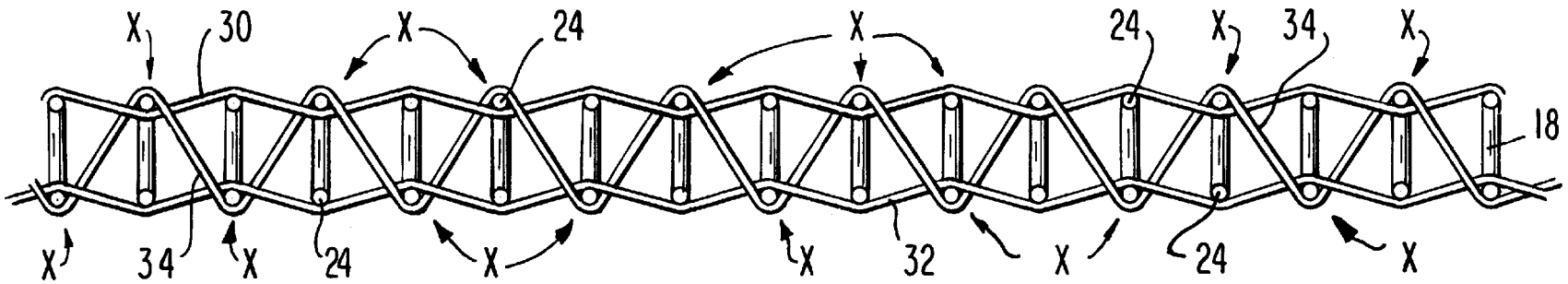
FIG. 7 is such a cross-sectional view of a fourth embodiment of the present invention.

FIG. 7 is a cross-sectional view, analogous to that presented in FIG. 4A, of a fourth embodiment of the present invention. FIG. 7 also shows seaming loops 18, formed by weft (MD) yarns 24, from within. Interwoven with the top side of the seaming loops 18 is an extra warp (CD) yarn 30, which interweaves with weft (MD) yarns 24 there in a plain weave. Interwoven with the bottom side of the seaming loops 18 is another extra warp (CD) yarn 32, which also interweaves with weft (MD) yarns 24 in a plain weave. As shown in FIG. 7, extra warp (CD) yarns 30,32 weave in step with one another; that is to say, each weaves over the top sides and under the bottom sides of the same seaming loops 18. Interwoven with the top side of alternate seaming loops 18 and with the bottom side of those in between is a leno yarn 34. More specifically, leno yarn 34 weaves over the top side of seaming loops 18 where extra warp (CD) yarn 30 weaves under the top side, and leno yarn 34 weaves under the bottom side of seaming loops 18 where extra warp (CD) yarn 32 weaves over the bottom side. When weaving over the top side of the seaming loops 18, leno yarn 34 also crosses over extra warp (CD) yarn 30, and, when weaving under the bottom side of the seaming loops 18, leno yarn 34 also crosses under extra warp (CD) yarn 32. This occurs at points "X" in FIG. 7. This locks the extra warp (CD) yarns 30,32 in position, and counteracts the tendency that extra warp (CD) yarn 30 would have to raise the seaming loops 18 where it weaves under their top sides and that extra warp (CD) yarn 32 would have to lower the seaming loops 18 where it weaves over their bottom sides.

Figure 8:
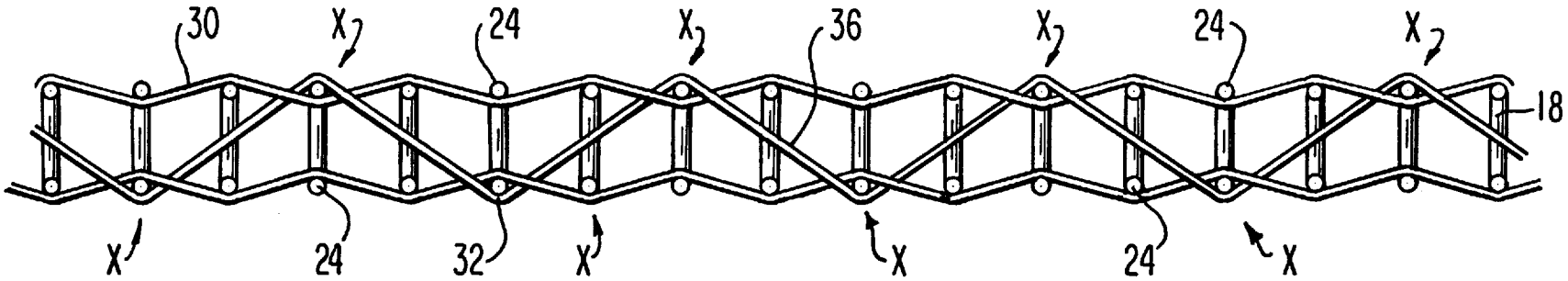
FIG. 8 is such a cross-sectional view of a fifth embodiment of the present invention.

FIG. 8 is a cross-sectional view, again analogous to that presented in FIG. 4A, of a fifth embodiment of the present invention. FIG. 8 also shows seaming loops 18, formed by weft (MD) yarns 24, from within. Interwoven with the top side of the seaming loops 18 is an extra warp (CD) yarn 30, which interweaves with weft (MD) yarns 24 there in a plain weave. Interwoven with the bottom side of the seaming loops 18 is another extra warp (CD) yarn 32, which also interweaves with weft (MD) yarns 24 in a plain weave. As shown in FIG. 8, extra warp (CD) yarns 30,32 weave out of step with one another; that is to say, extra warp (CD) yarn 30 weaves under the top side of those seaming loops 18 where extra warp (CD) yarn 32 weaves over the bottom side, and vice versa. Interwoven with the top side of every fourth seaming loop 18, and with the bottom side of every four seaming loop 18, the latter being halfway between the former, is a leno yarn 36. More specifically, leno yarn 36 weaves over the top side of seaming loops 18 where extra warp (CD) yarn 30 weaves under the top side, and leno yarn 36 weaves under the bottom side of seaming loops 18 where extra warp (CD) yarn 32 weaves over the bottom side. Leno yarn 36, then, weaves over the top side of one seaming loop 18, passes through the next seaming loop 18, weaves under the bottom side of the next seaming loop 18, and passes through the next seaming loop 18 in each repeat of its weave pattern. When weaving over the top side of the seaming loops 18, leno yarn 36 also crosses over extra warp (CD) yarn 30, and, when weaving under the bottom side of the seaming loops 18, leno yarn 36 also crosses under extra warp (CD) yarn 32. This occurs at points "X" in FIG. 8, and locks the extra warp (CD) yarns 30,32 in position, and, albeit to a lesser extent than the embodiment shown in FIG. 7, counteracts the tendency that extra warp (CD) yarn 30 would have to raise the seaming loops 18 where it weaves under their top sides, and that extra warp (CD) yarn 32 would have to lower the seaming loops 18 where it weaves over their bottom sides.

Figure 9:
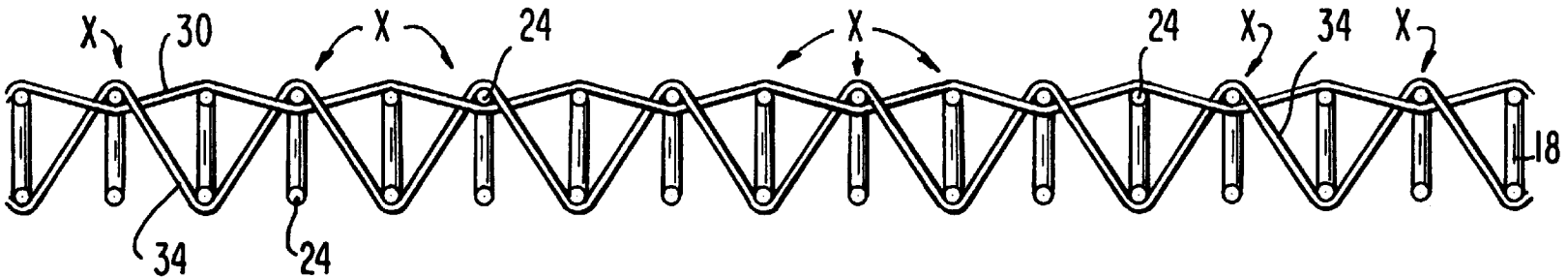
FIG. 9 is such a cross-sectional view of a sixth embodiment of the present invention.

FIG. 9 is a cross-sectional view, analogous to that presented in FIG. 4A, of a sixth embodiment of the present invention. FIG. 9 also shows seaming loops 18, formed by weft (MD) yarns 24, from within. Interwoven with the top side of the seaming loops 18 is an extra warp (CD) yarn 30, which interweaves with weft (MD) yarns 24 there in a plain weave. Interwoven with the top side of alternate seaming loops 18 and with the bottom side of those in between is a leno yarn 34. More specifically, leno yarn 34 weaves over the top side of seaming loops 18 where extra warp (CD) yarn 30 weaves under the top side, and leno yarn 34 weaves under the bottom side of those seaming loops in between. When weaving over the top side of the seaming loops 18, leno yarn 34 also crosses over extra warp (CD) yarn 30. This occurs at points "X" in FIG. 9, and locks the extra warp (CD) yarn 30 in position, and counteracts the tendency that extra warp (CD) yarn 30 would have to raise the seaming loops 18 where it weaves under their top sides.

It would be readily apparent to one of ordinary skill in the art that, instead of extra warp (CD) yarn 30 interweaving with the top side of seaming loops 18, an extra warp (CD) yarn, like extra warp (CD) yarn 32 in FIGS. 7 and 8, could interweave with the bottom side of seaming loops 18 in a variation of the embodiment shown in FIG. 9.

Figure 10:
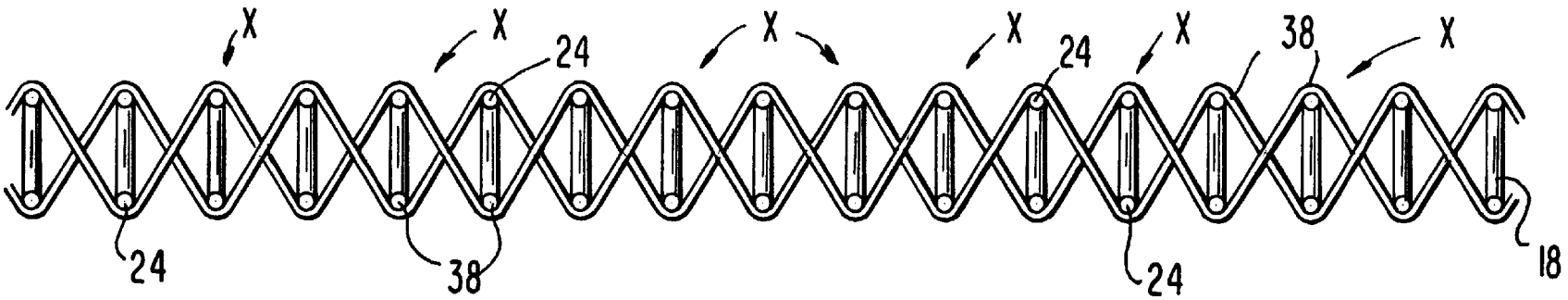
FIG. 10 is such a cross-sectional view of a seventh embodiment of the present invention.

FIG. 10 is a cross-sectional view, analogous to that presented in FIG. 4A, of a seventh embodiment of the present invention. FIG. 10 also shows seaming loops 18, formed by weft (MD) yarns 24, from within. Interwoven with the top and bottom sides of the seaming loops 18 are two leno yarns 38, which interweave with weft (MD) yarns 24 there in a leno weave. As such, in the particular weave shown in FIG. 10, each leno yarn 38 weaves over the top side of alternate weft (MD) yarns 24, and under the bottom side of those in between, one weft (MD) yarn 24 out of step with the other, so that each seaming loop 18 has a leno yarn 38 weaving over its top side and a leno yarn 38 weaving under its bottom side. Occasionally, at points "X" in FIG. 10, one of the leno yarns 38 crosses under the other to lock both in position.

In accordance with the present invention, any of the embodiments shown in FIGS. 4A through 10 may be used on the seaming loops 18 on one or both of the ends 12,14 of the fabric 10. Specifically, any one of the designs shown in FIGS. 4A through 10 may be used on one of the two ends 12,14, while none of the designs is used on the other of the two ends 12,14. Alternatively, one of the designs may be used on one of the two ends 12,14, while the same design, or a different design, is used on the other of the two ends 12,14. In a preferred embodiment, one of the two ends 12,14 has have the "top-side-only" design shown in FIG. 4A, while the other of the two ends has the "bottom-side-only" design shown in FIG. 5.

Extra warp (CD) yarns 26,28,30,32 and leno yarns 34,36, 38 may be yarns of any of the varieties used by those of ordinary skill in the art to weave paper machine clothing. That is to say, monofilament yarns, which are monofilament strands used singly, multifilament yarns, or plied/twisted yarns, in the form of plied monofilament or plied multifilament yarns, or yarns of any of the other forms used by those of ordinary skill in the art to weave paper machine clothing, may be used as extra warp (CD) yarns 26,28,30,32 and leno yarns 34,36,38. The yarns, or filaments thereof, may be of circular or non-circular cross section. For example, a trilobal texturized yarn, whose filaments have a trilobal cross section, may be used on the "no-flap" end, which is prone to wear. In a given design, extra warp (CD) yarns 26,28,30,32 and leno yarns 34,36,38 may be of the same or of different varieties of yarn, and those used on one of the two ends 12,14 may be of the same or of a different variety from those used on the other of the two ends 12,14. Any or all of extra warp (CD) yarns 26,28,30,32 and leno yarns 34,36,38 may alternatively be of metal wire, such as stainless steel wire.

When not of metal wire, extra warp (CD) yarns 26,28, 30,32 and leno yarns 34,36,38 comprise filaments extruded from a synthetic polymeric resin material, such as polyamide, polyester, polyetherketone, polypropylene, polyaramid, polyolefin and polyethylene terephthalate (PET) resins, and incorporated into yarns according to techniques well-known in the textile industry and particularly in the paper machine clothing.

Modifications to the above would be obvious to those of ordinary skill in the art, but would not bring the invention so modified beyond the scope of the appended claims.

What is claimed is:

1. An on-machine-seamable papermaker's fabric comprising:

a system of machine-direction (MD) yarns and a system of cross-machine-direction (CD) yarns, said yarns of said system of MD yarns being interwoven with said yarns of said system of CD yarns in a preselected weave pattern to form said papermaker's fabric in a rectangular shape with a length, a width, two lengthwise edges, two widthwise edges, a first side and a second side, said MD yarns forming seaming loops along each of said two widthwise edges, said seaming loops also having a first side and a second side coextensive with said first side and said second side of said papermaker's fabric; and at least two additional CD yarns not part of said system of CD yarns, said additional CD yarns being interwoven with at least one of said first side and said second side of said seaming loops at one of said two widthwise edges of said fabric in a leno weave.

2. An on-machine-seamable papermaker's fabric as claimed in claim 1 wherein said MD yarns extend back and forth continuously for said length of said papermaker's fabric between said two widthwise edges.

3. An on-machine-seamable papermaker's fabric as claimed in claim 1 wherein said preselected weave pattern is selected from the group consisting of single-layer, duplex, triplex and multi-layer weaves.

4. An on-machine-seamable papermaker's fabric as claimed in claim 1 wherein said preselected weave pattern is an 8-shed duplex weave pattern.

5. An on-machine-seamable papermaker's fabric as claimed in claim 1 wherein said preselected weave pattern is a duplex weave pattern wherein said system of MD yarns comprises first and second layers of MD yarns.

6. An on-machine-seamable papermaker's fabric as claimed in claim 1 wherein said MD yarns are of a variety of yarn selected from the group consisting of monofilament yarns, multifilament yarns, and plied/twisted yarns in the form of plied monofilament or plied multifilament yarns.

7. An on-machine-seamable papermaker's fabric as claimed in claim 1 wherein said MD yarns include filaments extruded from a polymeric resin material.

8. An on-machine-seamable papermaker's fabric as claimed in claim 6 wherein said polymeric resin material is selected from the group consisting of polyamide, polyester, polyetherketone, polypropylene, polyaramid, polyolefin and polyethylene terephthalate (PET) resins.

9. An on-machine-seamable papermaker's fabric as claimed in claim 1 wherein said at least two additional CD yarns are two extra CD yarns, said two extra CD yarns interweaving with said first side of said seaming loops in a leno weave.

10. An on-machine-seamable papermaker's fabric as claimed in claim 9 wherein said two extra CD yarns interweave with said first side of said seaming loops in the manner of a plain weave, one of said two extra CD yarns crossing beneath the other of said two extra CD yarns at preselected intervals to form said leno weave.

11. An on-machine-seamable papermaker's fabric as claimed in claim 10 wherein one of said two extra CD yarns crosses beneath the other of said two extra CD yarns at every other seaming loop.

12. An on-machine-seamable papermaker's fabric as claimed in claim 10 wherein one of said two extra CD yarns crosses beneath the other of said two extra CD yarns at every seaming loop.

13. An on-machine-seamable papermaker's fabric as claimed in claim 1 wherein said at least two additional CD yarns are two extra CD yarns, said two extra CD yarns interweaving with said second side of said seaming loops in a leno weave.

14. An on-machine-seamable papermaker's fabric as claimed in claim 13 wherein said two extra CD yarns interweave with said second side of said seaming loops in the manner of a plain weave, one of said two extra CD yarns crossing beneath the other of said two extra CD yarns at preselected intervals to form said leno weave.

15. An on-machine-seamable papermaker's fabric as claimed in claim 14 wherein one of said two extra CD yarns crosses beneath the other of said two extra CD yarns at every other seaming loop.

16. An on-machine-seamable papermaker's fabric as claimed in claim 14 wherein one of said two extra CD yarns crosses beneath the other of said two extra CD yarns at every seaming loop.

17. An on-machine-seamable papermaker's fabric as claimed in claim 1 wherein said at least two additional CD yarns are four extra CD yarns, two of said four extra CD yarns interweaving with said first side of said seaming loops in a leno weave, and the other two of said four extra CD yarns interweaving with said second side of said seaming loops in a leno weave.

18. An on-machine-seamable papermaker's fabric as claimed in claim 17 wherein said two of said four extra CD yarns interweave with said first side of said seaming loops in the manner of a plain weave, one of said two of said four extra CD yarns crossing beneath the other of said two of said four extra CD yarns at preselected intervals to form said leno weave, and said other two of said four extra CD yarns interweave with said second side of said seaming loops in the manner of a plain weave, one of said other two of said four extra CD yarns crossing beneath the other of said other two of said four extra CD yarns at preselected intervals to form said leno weave.

19. An on-machine-seamable papermaker's fabric as claimed in claim 18 wherein one of said two of said four extra CD yarns interweaving with said first side of said seaming loops crosses beneath the other of said two of said four extra CD yarns at every other seaming loop, and one of said other two of said four extra CD yarns interweaving with said second side of said seaming loops crosses beneath the other of said other two of said four extra CD yarns at every other seaming loop.

20. An on-machine-seamable papermaker's fabric as claimed in claim 18 wherein one of said two of said four extra CD yarns interweaving with said first side of said seaming loops crosses beneath the other of said two of said four extra CD yarns at every seaming loop, and one of said other two of said four extra CD yarns interweaving with said second side of said seaming loops crosses beneath the other of said other two of said four extra CD yarns at every seaming loop.

21. An on-machine-seamable papermaker's fabric as claimed in claim 1 wherein said at least two additional CD yarns are two extra CD yarns and a leno yarn, one of said two extra CD yarns interweaving with said first side of said seaming loops, the other of said two extra CD yarns interweaving with said second side of said seaming loops, and said leno yarn interweaving with both of said first and second sides of said seaming loops and with said two extra CD yarns in a leno weave.

22. An on-machine-seamable papermaker's fabric as claimed in claim 21 wherein said leno yarn crosses over said one of said two extra CD yarns when interweaving with said first side of said seaming loops, and crosses under said other of said two extra CD yarns when interweaving with said second side of said seaming loops.

23. An on-machine-seamable papermaker's fabric as claimed in claim 21 wherein said one of said two extra CD yarns interweaves with said first side of said seaming loops in the manner of a plain weave.

24. An on-machine-seamable papermaker's fabric as claimed in claim 21 wherein said other of said two CD yarns interweaves with said second side of said seaming loops in the manner of a plain weave.

25. An on-machine-seamable papermaker's fabric as claimed in claim 21 wherein said leno yarn interweaves between said first and second sides of adjacent seaming loops.

26. An on-machine-seamable papermaker's fabric as claimed in claim 21 wherein said leno yarn interweaves between said first and second sides of every other seaming loop.

27. An on-machine-seamable papermaker's fabric as claimed in claim 1 wherein said at least two additional CD yarns are an extra CD yarn and a leno yarn, said extra CD yarn interweaving with said first side of said seaming loops, and said leno yarn interweaving with both of said first and second sides of said seaming loops and with said extra CD yarn in a leno weave.

28. An on-machine-seamable papermaker's fabric as claimed in claim 27 wherein said leno yarn crosses over said extra CD yarn when interweaving with said first side of said seaming loops.

29. An on-machine-seamable papermaker's fabric as claimed in claim 27 wherein said extra CD yarn interweaves with said first side of said seaming loops in the manner of a plain weave.

30. An on-machine-seamable papermaker's fabric as claimed in claim 27 wherein said leno yarn interweaves between said first and second sides of adjacent seaming loops.

31. An on-machine-seamable papermaker's fabric as claimed in claim 27 wherein said leno yarn interweaves between said first and second sides of every other seaming loop.

32. An on-machine-seamable papermaker's fabric as claimed in claim 1 wherein said at least two additional CD yarns are an extra CD yarn and a leno yarn, said extra CD yarn interweaving with said second side of said seaming loops, and said leno yarn interweaving with both of said first and second sides of said seaming loops and with said extra CD yarn in a leno weave.

33. An on-machine-seamable papermaker's fabric as claimed in claim 32 wherein said leno yarn crosses under said extra CD yarn when interweaving with said second side of said seaming loops.

34. An on-machine-seamable papermaker's fabric as claimed in claim 32 wherein said extra CD yarn interweaves with said second side of said seaming loops in the manner of a plain weave.

35. An on-machine-seamable papermaker's fabric as claimed in claim 32 wherein said leno yarn interweaves between said first and second sides of adjacent seaming loops.

36. An on-machine-seamable papermaker's fabric as claimed in claim 32 wherein said leno yarn interweaves between said first and second sides of every other seaming loop.

37. An on-machine-seamable papermaker's fabric as claimed in claim 1 wherein said at least two additional CD yarns are two leno yarns, said two leno yarns interweaving between said first and second sides of said seaming loops in a leno weave.

38. An on-machine-seamable papermaker's fabric as claimed in claim 37 wherein one of said two leno yarns crosses beneath the other of said two leno yarns at preselected intervals to form said leno weave.

39. An on-machine-seamable papermaker's fabric as claimed in claim 38 wherein one of said two leno yarns crosses beneath the other of said two leno yarns at every other seaming loop.

40. An on-machine-seamable papermaker's fabric as claimed in claim 38 wherein one of said two leno yarns crosses beneath the other of said two leno yarns at every seaming loop.

41. An on-machine-seamable papermaker's fabric as claimed in claim 1 further comprising at least two additional CD yarns not part of said system of CD yarns, said additional CD yarns being interwoven with at least one of said first side and said second side of said seaming loops at the other of said two widthwise edges of said fabric in a leno weave.

42. An on-machine-seamable papermaker's fabric as claimed in claim 41 wherein said at least two additional CD yarns interwoven with said seaming loops at one of said two widthwise edges of said fabric are two extra CD yarns interwoven with said first side of said seaming loops, and said at least two additional CD yarns interwoven with said seaming loops at the other of said two widthwise edges of said fabric are two extra CD yarns interwoven with said second side of said seaming loops.

43. An on-machine-seamable papermaker's fabric as claimed in claim 1 wherein said CD yarns are of a variety of yarns selected from the group consisting of monofilament yarns, multifilament yarns, and plied/twisted yarns in the form of plied monofilament or plied multifilament yarns.

44. An on-machine-seamable papermaker's fabric as claimed in claim 1 wherein said CD yarns include filaments extruded from a polymeric resin material.

45. An on-machine-seamable papermaker's fabric as claimed in claim 44 wherein said polymeric resin material is selected from the group consisting of polyamide, polyester, polyetherketone, polypropylene, polyaramid, polyolefin and polyethylene terephthalate (PET) resin.

46. An on-machine-seamable papermaker's fabric as claimed in claim 1 wherein said additional CD yarns are of a variety of yarn selected from the group consisting of monofilament yarns, multifilament yarns, and plied/twisted yarns in the form of plied monofilament or plied multifilament yarns.

47. An on-machine-seamable papermaker's fabric as claimed in claim 1 wherein said additional CD yarns include filaments extruded from a polymeric resin material.

48. An on-machine-seamable papermaker's fabric as claimed in claim 47 wherein said polymeric resin material is selected from the group consisting of polyamide, polyester, polyetherketone, polypropylene, polyaramid, polyolefin and polyethylene terephthalate (PET) resin.

49. An on-machine-seamable papermaker's fabric as claimed in claim 1 wherein at least one additional CD yarn is a trilobal texturized yarn.

50. An on-machine-seamable papermaker's fabric as claimed in claim 1 wherein at least one additional CD yarn is a metal wire.

51. An on-machine-seamable papermaker's fabric as claimed in claim 50 wherein said metal wire is of stainless steel.

52. An on-machine-seamable papermaker's fabric as claimed in claim 1 wherein said additional CD yarns are of one variety of yarn.

53. An on-machine-seamable papermaker's fabric as claimed in claim 1 wherein said additional CD yarns are of different varieties of yarn.

54. An on-machine-seamable papermaker's fabric as claimed in claim 1 wherein said additional CD yarns include filaments of non-circular cross section.

* * * * *